United States Patent [19]

Warmath

[11] Patent Number: 4,658,996

[45] Date of Patent: Apr. 21, 1987

[54] PINCH CLIP GARMENT HANGER

[76] Inventor: John G. Warmath, 175 Steuben St., Brooklyn, N.Y. 11205

[21] Appl. No.: 774,903

[22] Filed: Sep. 11, 1985

[51] Int. Cl.[4] ..... A47G 25/48

[52] U.S. Cl. ..... 223/96; 24/511; 24/562; D6/326

[58] Field of Search ..... 24/499, 500, 511, 562, 24/545; 223/93, 91, 96, DIG. 2; D6/326

[56] References Cited

U.S. PATENT DOCUMENTS

| | | | |
|---|---|---|---|
| 1,357,233 | 11/1920 | Hagelstein | 24/500 X |
| 2,261,005 | 10/1941 | Thompson et al. | 24/511 X |
| 3,906,957 | 9/1975 | Weston | 24/562 X |
| 3,923,213 | 12/1975 | George et al. | 223/96 |
| 4,020,530 | 5/1977 | Sartore | 24/511 |
| 4,192,441 | 3/1980 | Batts | 24/545 X |
| 4,261,121 | 4/1981 | Coon | 223/96 X |
| 4,382,531 | 5/1983 | Bisk et al. | 223/93 X |
| 4,395,799 | 8/1983 | Batts | 223/96 X |
| 4,446,996 | 5/1984 | Garrison | 223/96 |

FOREIGN PATENT DOCUMENTS

| | | | |
|---|---|---|---|
| 898825 | 6/1962 | United Kingdom | 24/511 |

*Primary Examiner*—Werner H. Schroeder
*Assistant Examiner*—Andrew M. Falik
*Attorney, Agent, or Firm*—Louis E. Marn

[57] ABSTRACT

A hanger assembly comprising an elongated cross-bar having a hook member and clip members integrally formed at end portions of the cross-bar intermediate the hook member. The clip members include cooperating jaw members and an intermediate hinge member shaped to facilitate a positioning of a spring member in the clip member to spring bias the jaw members thereof against each other.

7 Claims, 5 Drawing Figures

PINCH CLIP GARMENT HANGER

FIELD OF THE INVENTION

This invention relates to a hanger, and more particularly to a pinch clip garment hanger.

BACKGROUND OF THE INVENTION

Numerous types of hangers have been used to hang garments, such as clothes racks. Generally the garment, such as a skirt, slacks or pants, is secured by clips to hold the garment on the hanger. In some instances, the hangers have been made in a closed loop configuration with a wire cross-bar on which a pair of clips are mounted to engage a garment, e.g. the clips described in U.S. Pat. No. 3,456,262. The pairs of clips have been adjustable in relative position to one another along the length of the cross-bar in order to accomodate different size garments, and to maintain a garment taut on the hanger.

The manufacture of a hanger with adjustable clips, as hereinabove described, has generally been relatively costly as the clips must first be individually assembled, then assembled onto the hanger rod, and then the hanger rod must be assembled into a garment hanger body. Thus, not only is the assembly time-consuming, but also a multiplicity of different assembly operations are required leading to increased labor and material costs.

In U.S. Pat. No. 4,009,807 to Coon, there is described a garment hanger comprised of an elongated cross-bar and a pair of clips wherein each clip is disposed at a respective end of the cross-bar and includes a pair of jaws and a spring biasing the jaws together. One jaw of each clip is formed integrally with the cross-bar while the other jaw is mounted on the first jaw in abutting pivotal relation on the first jaw and held in place by the spring.

OBJECTS OF THE INVENTION

An object of the present invention is to provide an improved pinch clip garment hanger.

Another object of the present invention is to provide an improved pinch clip garment hanger of substantially integral construction.

Still another object of the present invention is to provide an improved pinch clip garment hanger of substantially integral construction requiring only assembly of spring clip members.

Yet another object of the present invention is to provide an improved pinch clip garment hanger permitting of facile assembly of spring clip members.

SUMMARY OF THE INVENTION

These and other objects of the present invention are achieved by a hanger assembly comprised of an elongated cross-bar having a hook member and clip members integrally formed at end portions of the cross-bar intermediate the hook member and wherein the clip members include cooperating jaw members and an intermediate hinge member shaped to facilitate positioning of a spring member in the clip member to spring bias the jaw members thereof against each other.

BRIEF DESCRIPTION OF THE DRAWINGS

Further objects and advantages of the present invention will become apparent from the following detailed description when taken in conjunction with the accompanying drawings wherein.

DETAILED DESCRIPTION OF THE INVENTION

Figure 1:
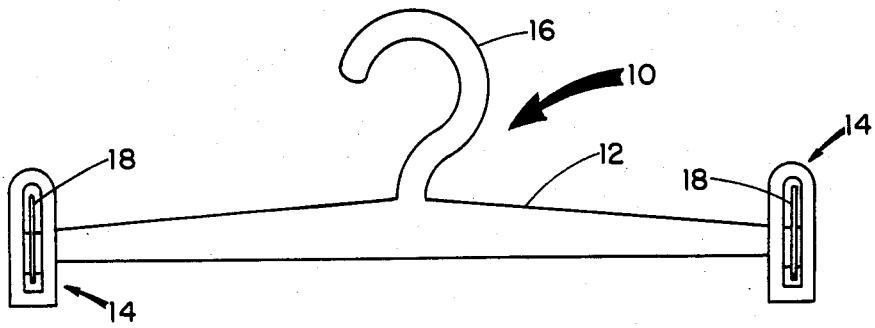
FIG. 1 is an elevational view of the improved pinch clip garment hanger of the present invention.
Figure 2:
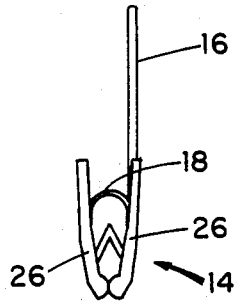
FIG. 2 is a side view thereof.

Referring now to the drawings, and particularly to FIGS. 1 and 2, there is illustrated a hanger, generally indicated as 10, formed of a plastic material and including a cross-bar 12, clip members 14 disposed at terminal ends of the cross-bar 12 and a hook 16 formed on the cross-bar 12 intermediate the clip members 14. Each of the clip members 14 are provided with clip springs 18, as more fully hereinafter discussed. The cross-bar 12, the clip members 14 and the hook 16 are integrally formed into the garment hanger 10 in a molding operation, e.g. by injection molding techniques from a plastic material which is generally a thermoplastic resin, such as high density polyethylene, or the like.

Figure 3:
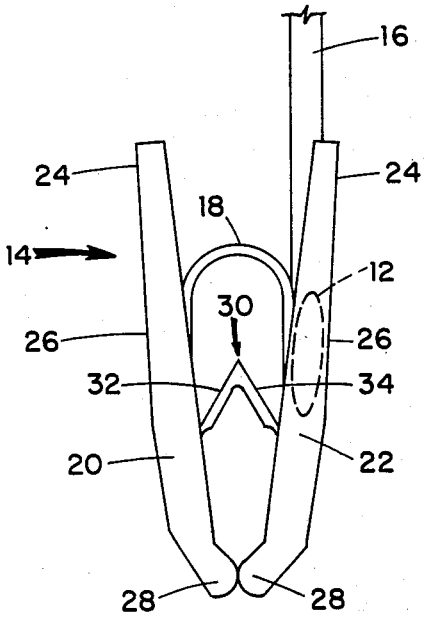
FIG. 3 is an enlarged view of FIG. 2 of a jaw member of the garment hanger of the present invention.
Figure 4:
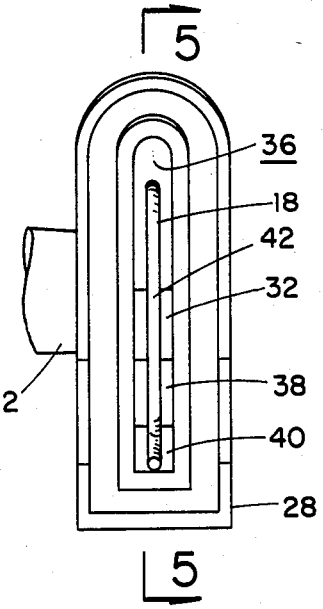
FIG. 4 is a front view of the jaw member of FIG. 3.
Figure 5:
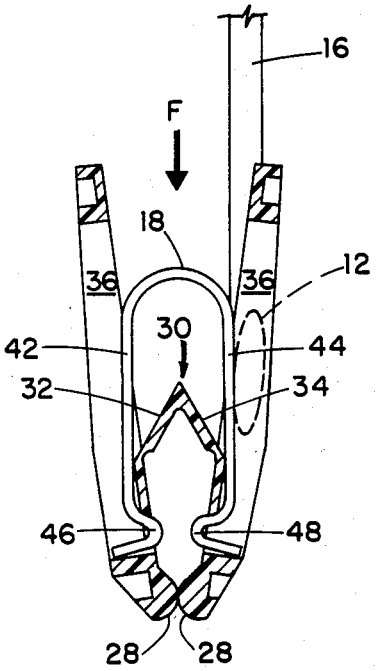
FIG. 5 is a cross-sectional view taken along the line V—V of FIG. 4.

Referring now to FIGS. 3 to 5, the clip members 14 are of identical construction, and accordingly, only one clip member 14 will be hereinafter specifically described. The clip members 14 are formed at a terminal end portion of the cross-bar 12 of the garment hanger 10. As shown, each clip member 14 includes cooperating paired jaw members 20 and 22 and a generally inverted U-shaped clip spring member 18 which biases the jaw members 20 and 22. Each jaw member 20 and 22 is comprised of an upper finger receiving portion 24, an intermediate portion 26 and a lower gripping portion 28, and are connected and hingeably mounted to one another by an inverted flexible V-shaped connecting member, generally indicated as 30, integrally formed therewith and including downwardly sloping wall portions 32 and 34.

Each jaw member 20 and 22 is formed with an elongated channel 36 intermediate an longitudinal axis thereof, referring particularly to FIG. 4. A lower wall portion 38 is formed within the elongated channel 36 as part of the intermediate portions 26 of the jaw members 20 and 22 and integrally meets downwardly sloping wall portions 32 and 34 of the connecting member 30 at a reduced cross-section thereof thereby forming a hinge for each of the jaw members 20 and 22 about the connecting element 30. A detent 40 is formed within the elongated channel 36 between the lower wall portion 38 and the lower gripping portion 28 of the jaw members 20 and 22, as more fully hereinafter discussed.

The clip spring 18 is generally of an inverted U-shaped configuration, referring particularly to FIG. 5 including leg sections 42 and 44 terminating in outwardly extending hook-shaped feet portions 46 and 48, respectively. In mounting, the clip spring 18 is positioned above the inverted inclined planes of the connecting member 30 such that the hook-shaped feet portions 46 and 48 are in contact with the surface of downwardly sloping wall portions 32 and 34 forming the inverted V-shaped connecting member 30. With continued downward force (as indicated by the arrow "F"), the hook-shaped feet portions 46 and 48 are caused to ride up the surfaces of the downwardly sloping wall portions 32 and 34, respectively, of the inverted V-shaped connecting member 30 and thence along the surface of lower wall portion 38 to a point where the hook-shaped feet portions 46 and 48 are captured in locking interrelationship within the respective detents 40 in each jaw member 20 and 22, respectively.

The clip spring 18 is dimensioned and configured as hereinabove described to insure sufficient inwardly biasing force on the lower gripping portions 28 of the jaw members 20 and 22 in the assembled configuration of the pinch clip garment hanger 10.

While the invention has been described with reference to the preferred embodiment in the context of the garment hanger, it will be understood by one skilled in the art that the clip member, per se, may be formed and subsequently attached to a cross-bar including a hook to form a garment hanger.

While the invention herein has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed:

1. A hanger assembly which comprises:

an elongated cross-bar, a hook positioned at an intermediate portion of said cross-bar and clip members positioned at terminal end portions of said cross-bar, said cross-bar, hook and clip members being integrally formed of a plastic material, each of said clip members comprising cooperating paired jaw members joined together by a connecting member, said connecting member being in the shape of an inverted V, each of said jaw members including a gripping portion for cooperating with each other, each of said jaw members being formed with a channel and a detent; and a spring member including leg portions each having a foot member for slidable insertion through a respective channel of each of said paired jaw members to a point wherein each foot member is disposed in a respective detent of each of said jaw members for biasing said gripping portion of said paired jaw members against one another.

2. A pinch clip for a hanger assembly which comprises:

cooperating paired jaw members integrally formed of a plastic material and joined together by a connecting member, said connection member being in the shape of an inverted V, each of said jaw members including a gripping portion for cooperating with each other, each of said jaw members being formed with a channel and a detent; and a spring member including leg portions each having a foot member for slidable insertion through a respective channel of each of said paired jaw members to a point wherein each foot member is disposed in a respective detent of each of said jaw members for biasing said gripping portion of said paired jaw members against one another.

3. A hanger assembly which comprises:

an elongated cross-bar, a hook positioned at an intermediate portion of said cross-bar and clip members positioned at terminal end portions of said cross-bar, said cross-bar, hook and clip members being integrally formed of a plastic material, each of said clip members comprising cooperating paired jaw members joined together by a connecting member, said connecting member including an inclined plane, each of said jaw members including a gripping portion for cooperating with each other, each of said jaw members being formed with a channel and a detent; and a spring member including leg portions each having a foot member for slidable insertion through a respective channel of each of said paired jaw members to a point wherein each foot member is disposed in a respective detent of each of said jaw members for biasing said gripping portion of said paired jaw members against one another.

4. The hanger assembly as defined in claims 3 or 1 wherein said spring member is U-shaped.

5. The hanger assembly as defined in claims 3 or 1 wherein said cross-bar is integrally formed with one of said jaw members of each of said clip member.

6. A pinch clip for a hanger assembly which comprises:

cooperating paired jaw members integrally formed of a plastic material and joined together by a connecting member, said connecting member including an inclined plane, each of said jaw members including a gripping portion for cooperating with each other, each of said jaw members being formed with a channel and a detent; and a spring member including leg portions each having a foot member for slidable insertion through a respective channel of each of said paired jaw members to a point wherein each foot member is disposed in a respective detent of each of said jaw members for biasing said gripping portion of said paired jaw members against one another.

7. The pinch clip as defined in claims 6 or 2 wherein said spring member is U-shaped.

* * * * *